United States Patent [19]

Biba

[11] Patent Number: 5,035,126

[45] Date of Patent: Jul. 30, 1991

[54] DETACHABLE SECURITY ASSEMBLY

[75] Inventor: Kenneth Biba, 250 N. 21st St., Kenilworth, N.J. 07033

[73] Assignees: Kenneth R. Biba; Virginia A. Biba, both of Kenilworth, N.J.

[21] Appl. No.: 512,472

[22] Filed: Apr. 23, 1990

[51] Int. Cl.[5] ..... E05B 73/00

[52] U.S. Cl. ..... 70/18; 70/49

[58] Field of Search ..... 70/18, 19, 30, 49, 52

[56] References Cited

U.S. PATENT DOCUMENTS

| | | | |
|---|---|---|---|
| 1,520,902 | 12/1924 | Junkume | 70/49 |
| 1,921,434 | 8/1933 | Stone | 70/49 |
| 3,987,653 | 10/1976 | Lyon | 70/19 |
| 4,090,386 | 5/1978 | Bianco | 70/19 |
| 4,112,716 | 9/1978 | Wippich | 70/49 |

FOREIGN PATENT DOCUMENTS

| | | | |
|---|---|---|---|
| 312126 | 5/1919 | Fed. Rep. of Germany | 70/18 |

*Primary Examiner*—Robert L. Wolfe

[57] ABSTRACT

A latch for securing the door of an animal cage or cell which comprises a cylindrical metal barrel having an open end internally screw threaded, and an opposite end internally constricted for holding the terminal of a cable which is interposed in slideable relation into the constriction. The cable is constructed to bind the cage door frame to the door post. The other end of the cable terminates in a loop which fits into a biased slot near the end of the metal barrel. A key interposed from the open end engages a screw threaded arbor stud, rotating it to move along the inner axis of the barrel. The screw threaded arbor stud has an axial projection at its inner end which penetrates the loop and holds it in place in fully locked position. When the key is removed from the barrel, the screw member is inaccessible and cannot be loosened, until the key is reapplied by an attendant or keeper to re-engage the arbor stud, releasing the loop of the cable.

7 Claims, 3 Drawing Sheets

DETACHABLE SECURITY ASSEMBLY

This relates in general to a detachable security device constructed to secure a plurality of elements latched together with a cable for locking with a retrievable key. More particularly, the invention relates to a portable security device for preventing a cell or animal cage from being opened without the use of an authorized key in possession of an attendant or keeper.

BACKGROUND OF THE INVENTION

When cages or cells have their doors latched together by padlocks or cables of the usual type, it has been found that intelligent animals, especially primates, are able to reach the locks and manipulate them with their fingers until they are opened; and they are then able to escape from their cage.

It is the principal object of this invention to provide a simple, light-weight latch for securing the door of an animal cage or cell for latching the bars of the cage door in place with a strong cable, the ends of which cannot be reached and manipulated by the incarcerated animal and are only accessible for release by an attendant or keeper with a key.

This and other objects are realized in accordance with the present invention in a device comprising a hollow cylindrical barrel open at one end, and partly closed at the other end to hold in place a cable element, terminating in a stop which is caught in an axially-disposed constriction at the end of the barrel. The other end of the cable takes the form of a loop. Near the cable end of the barrel is a slot cut diagonally to the axis of the barrel and passing into the hollow axial chamber of the barrel. The open end of the barrel is internally screw-threaded to accommodate a screw-threaded arbor stud having a cylindrical nub projecting along the axis towards the cable end of the barrel. The arbor stud is moved longitudinal in the barrel along the internal screw threads by application of a key through the open end of the barrel. The key has a central female slot in the base of its shank which accommodates a boss on the arbor stud and rotates the arbor stud in the barrel when the key is interposed and turned. The cylindrical nub on the inner end of the arbor stud is constructed to penetrate and hold in place the looped end of the cable when the loop is interposed into the cylindrical barrel through the diagonal slot. When the shank of the key has been removed, the screw-threaded arbor stud and the looped end of the cable are secure in the barrel beyond reach of animal or human fingers. Thus, the latch cannot be opened until the key is reapplied through the open end of the barrel to loosen the arbor stud.

Other objects, features and advantages of the detachable security device of my invention will be apparent from a study of the attached drawings with reference to the detailed description hereinafter.

SHORT DESCRIPTION OF THE DRAWINGS

Figure 7A:
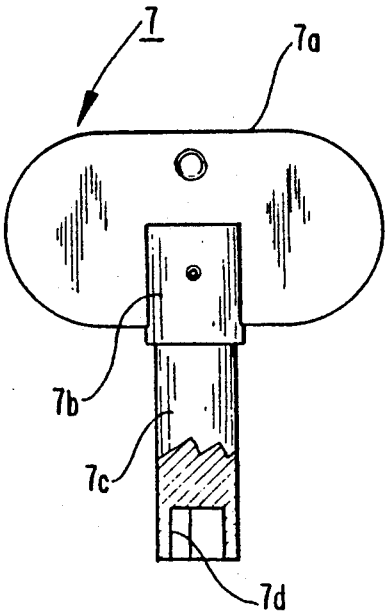
Figure 7B:
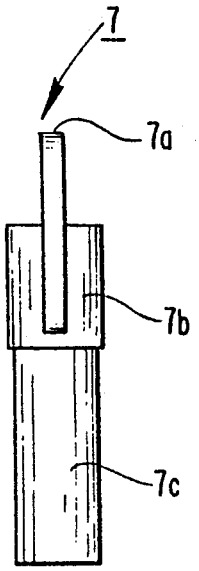

FIGS. 7A and 7B, respectively, show the front and side elevation of the key constructed to move the screw threaded arbor stud nub in a longitudinal direction in the cylindrical barrel of FIGS. 1–6.

DETAILED DESCRIPTION OF THE INVENTION

Figure 1:
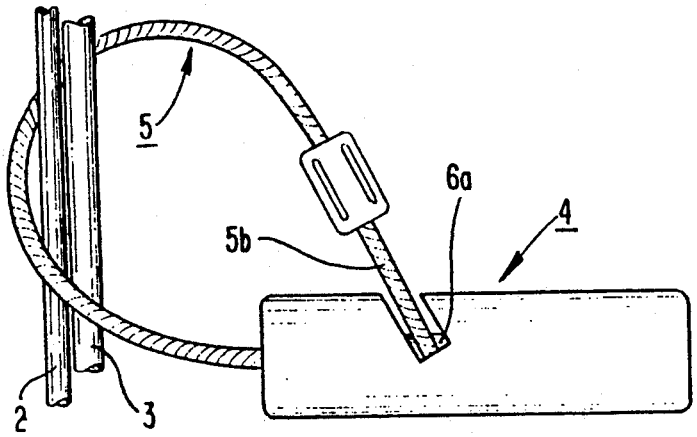
FIG. 1 shows, in perspective, the improved detachable security assembly of the present invention locked to secure the door of a cage or cell in securely latched position.
Figure 2:
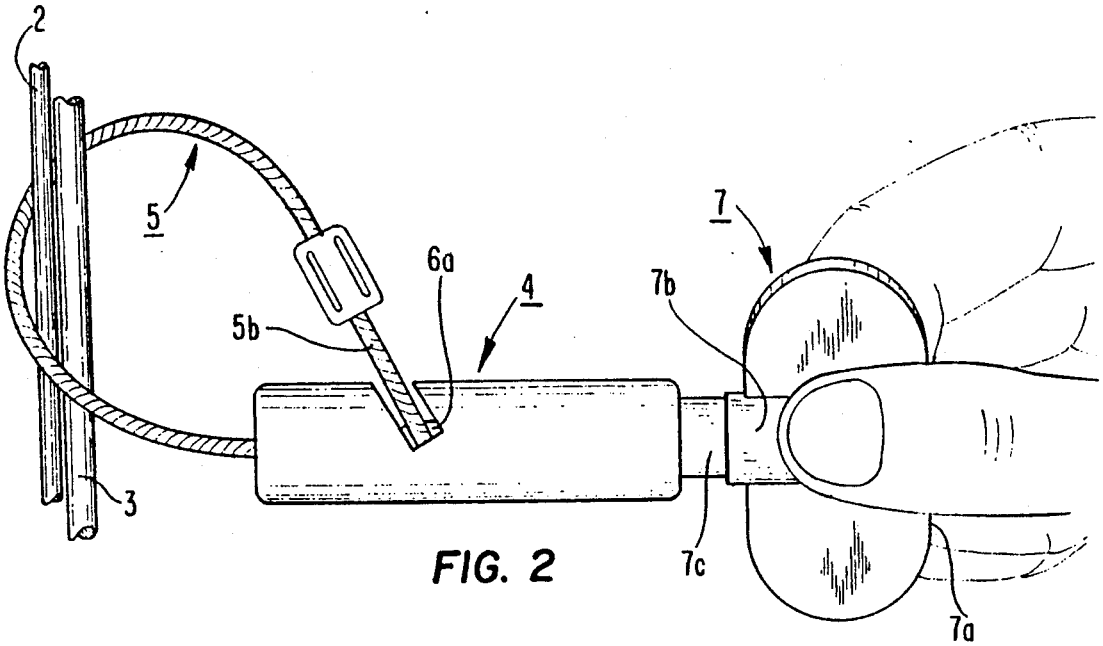
FIG. 2 shows, in perspective, a key being applied to unlock the detachable security assembly of FIG. 1.
Figure 3:
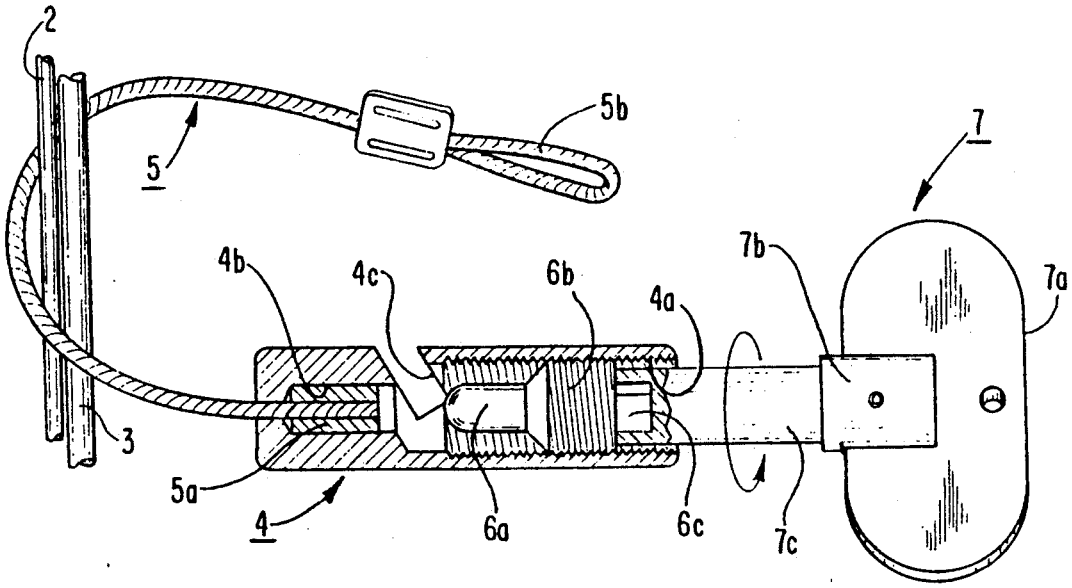
FIG. 3 shows the detachable security assembly of FIG. 1 being released after being unlocked by the key as shown in FIG. 2.
Figure 4:
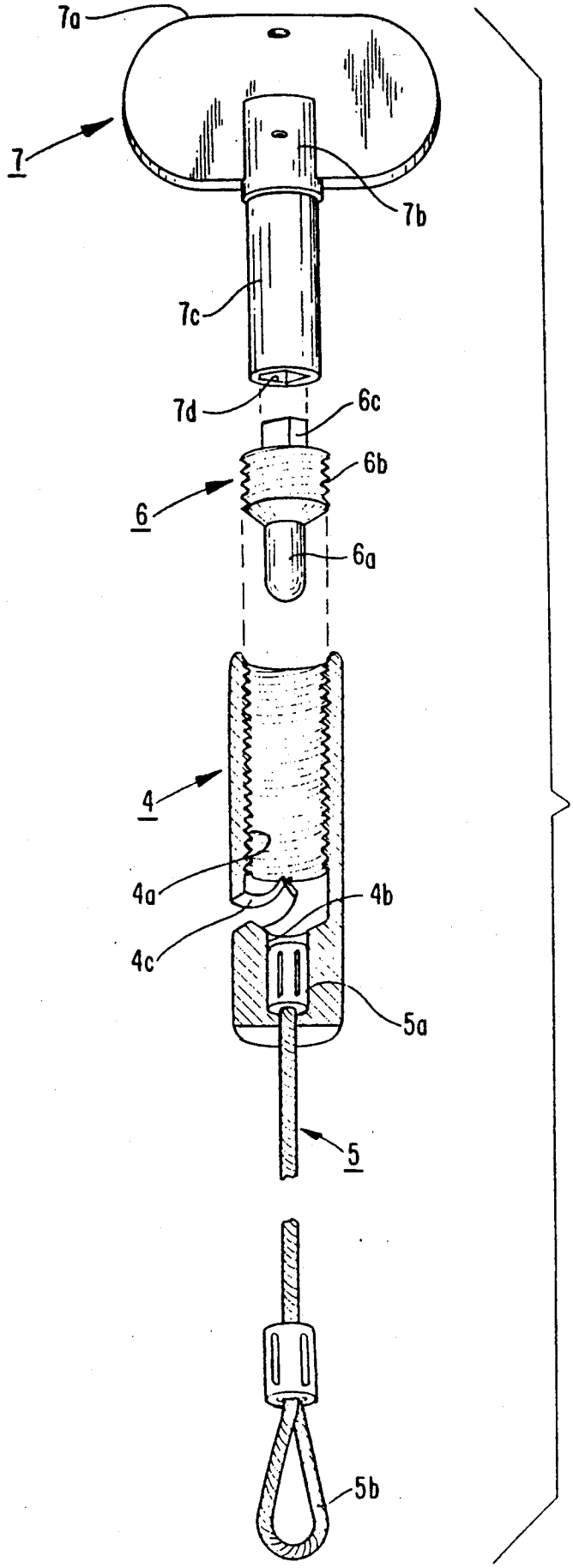
FIG. 4 is an exploded view of the key and lock assembly of FIGS. 1–3, with the cylindrical barrel of the lock being shown in section.
Figure 5:
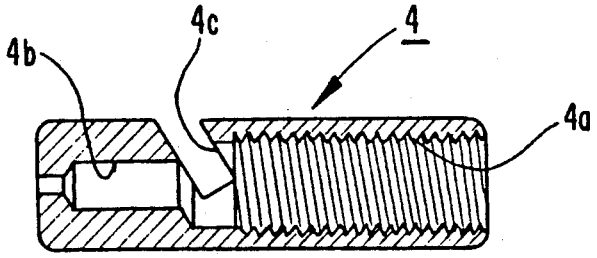
FIG. 5 is a longitudinal sectional showing of the cylindrical barrel of the lock of FIGS. 1–4.
Figure 6:
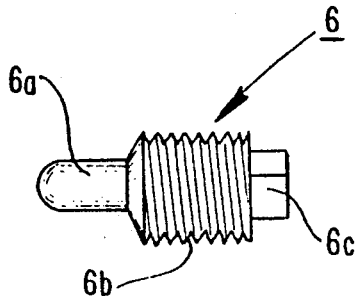
FIG. 6 is a side elevational view of the screw threaded arbor stud of FIGS. 1–4 which is constructed to be moved lengthwise in the cylindrical barrel of FIGS. 1–5.

Referring in detail to the drawings, FIG. 1 shows the latch 1 of the present invention locked in place between the door frame 2 and the door 3 of an animal cage. The lock assembly 1 comprises a stainless steel barrel 4, which, in the present illustration is, for example, about 2⅜ inches in overall length, and 0.61 inch in outer diameter, which has been hollowed out internally to have an inner chamber **4*a* of, say, 0.5 inch diameter running longitudinally 1½ inches from the open end to an internal shoulder ⅞ inch from the other end. The latter is partially closed, forming a second internal chamber 4*b* extending 9/16 inch along the axis, and narrowing down to a constricted bore 4*d***, say, 0.1 inch in diameter, which extends, say, ⅛ inch to the inner end.

The chamber **4*a* at the outer end is screw threaded along the inner wall for a length, say 1½ inches. A diaganol cut 4*c* is made into the lateral wall of the barrel 4** forming an angle of, say, 60 degrees with the longitudinal axis. The cut extends from the outer wall inward, a radial distance of, say, 0.42 inch, and is 3/16 inch wide.

Slideably disposed on the internal end of the barrel 4 is a cable 5. The latter may, for example, take the form of a conventional twist of stainless-steel strands, having an overall diameter of 3/16 inch, which is 36 inches long, terminating at one end in a cylindrical stop member **5*a*, which is welded or otherwise secured in axial relation to the cable end. Stop member 5*a*, is, say, 0.4 inch along the inner axis and 0.249 inch in diameter at its inner end so that it fits into and slideably engages the constricted chamber 4*b* of the barrel 4. The other end 5*b* of the cable 5 terminates in a loop, the end of which is welded or otherwise secured to itself to form an inner opening about a quarter inch in diameter, the flat loop 5*b* being shaped to just slip into the slot 4*c* of the barrel 4**, with the opening transverse to the axis.

In order to disengage and engage the lock, a key member 7 of the presently described illustrative embodiment may be also of stainless steel or any similar material. Key 7 comprises shaft, say, 3½ inches long and comprising an upper shaft member **7*b* 1¼ inches along its axis, and having a diameter, say, ½ inch, and a lower portion 7*c* extending axially therefrom, which is 2 inches along the axis and has a smaller diameter of 0.45 inch. 7*c* terminates at the inner end in an internal axial slot 7*d* which is say ¼ inch in diameter and ¼ inch deep. The outer end of the key 7 has an eliptical wing portion 7*a* which is say 1 inch wide and 2 inches across and which is bolted or otherwise secured to the outer end of shaft 7*b* to permit the key 7** to be manipulated to rotate with the fingers of the user.

The key 7 is designed, when interposed into the open end of the barrel 4, to rotate and move longitudinally an arbor stud 6. The latter, which is shown in side elevation in FIG. 6 of the drawings, is say 1.1 inches in overall length. It has an axially-projecting boss 6*c* which is 0.2 inch along the axis which is shaped to exactly fit into and engage the slot 7*d* in the key 7.

In the present embodiment, the cross-section of boss 6*c* is in the form of a pentagon which exactly conforms to the fine flat internal surfaces of the slot 7*d*, which it slideably engages, and a section of which slot also takes the form of a pentagon in the present illustrative embodiment. Actually, the boss 6*c* and slot 7*d*, in section, may assume the forms of any matching polygon, so that when boss 6*c* engages slot 7*d*, the two lock together and rotate as a unit in a plane normal to the axis of barrel 4.

Thus, when the key 7 is interposed into the opening 4*b*, the key engages and turns the arbor stud 6 and moves the same in a longitudinal direction in the hollow barrel 4. The arbor stud 6 has a central screw threaded portion 6*b* which is say 0.56 inch in diameter and is screw threaded for a distance 0.33 inch in an axial direction, and which engages the inner screw threads 4*a* of the barrel 4. The arbor stud 6 terminates at its inner end in a cylindrical projection 6*a* which extends 0.475 inch along the axis and is 0.245 inch in diameter, and is dimensioned to just penetrate and engage the loop 5*b* of the cable 5 when the same is in place in the slot 4*c*.

Thus referring again to the drawings, FIG. 1 shows the cable 5 with the loop 5*b* interposed in place in the slot 4*c* so that the latch is then securely engaged with the key 7, and the internal elements of the lock are completely inaccessible from the open end 4*a* of the barrel 4. Thus, the incarcerated animal is unable to reach in with his fingers and disengage the latch.

When a keeper or attendant wishes to open the latch, the shaft 7*b*, 7*c* of the key 7 is interposed into the open end 4*a* of the barrel 4 engaging the arbor stud 6. The key 7 is rotated by means of the wing portion 7*a* so that the arbor stud 6 is moved outward along the axis causing, the projection 6*a* to become disengaged from the loop 5*b*. The cable 5 can then be disengaged from the door frame 3 and the latch released.

It will be understood that the invention is not limited to the specific structure or dimensions which are given herein merely by way of example, but may be of different sizes and shapes, the scope of the invention being defined only by the appended claims.

What I claim is:

1. A latch for securing the door of a cage or cell comprising in combination:

a hollow metal barrel having a first internal screw threaded chamber open at one end which leads into a second chamber of constricted diameter which closes down to a small bore at the other end;

said barrel having a cut which penetrates through the lateral wall into the interior of said barrel adjacent said second chamber;

a cable having one end slideably held in place in the small bore of said barrel and terminating at its other end in a fixed loop constructed to fit into said cut;

a screw threaded arbor stud constructed to fit into and to move to and fro in an axial direction between said first and second chambers in said barrel by engaging said internal screw threads in said first chamber, said arbor stud having a projection directed to engage and hold in place the loop of said cable when said loop is interposed into said cut;

and means comprising a key constructed to be removably interposed into the open end of said barrel, and having means for engaging and turning said arbor stud to move said arbor stud in a longitudinal direction to and fro between said first and second chambers depending on whether said key is turned in a clockwise or counterclockwise direction.

2. The combination in accordance with claim 1 wherein the principal direction of said cut forms an acute angle with the axis of said barrel, said angle having its open end directed toward the constricted end of said barrel.

3. The combination in accordance with claim 2 wherein said acute angle approximates 60 degrees.

4. The combination in accordance with claim 1 wherein said means comprising a key comprises a wing portion disposed in T-shaped relation to a shank which fits into the open end of said barrel, said shank having an axially disposed slot in its inner end; and wherein said screw-threaded arbor stud has an axially-directed boss which is constructed to engage and lock into the slot in said shank whereby said key and said arbor stud are rotated as a unit.

5. The combination in accordance with claim 1 wherein said means comprising a key comprises a shank having a slot centered on the inner end of said shank, said slot having a preselected shape in a plane normal to the axis of said barrel; and wherein said arbor stud has a boss having a shape which is constructed to exactly engage the preselected shape of said slot in slideable locking relation, whereby said arbor stud and said shaft rotates as a unit in a plane normal to the axis of said barrel.

6. The combination in accordance with claim 5 wherein said slot and said boss each have matching polygonal shapes in a plane normal to the axis of said barrel.

7. The combination in accordance with claim 1 wherein said slot and said boss each have matching pentagonal shapes in a plane normal to the axis of said barrel.

* * * * *